United States Patent [19]

Juba

[11] 4,196,409

[45] Apr. 1, 1980

[54] MULTIPLE FUSE DEVICE

[75] Inventor: Hisashi Juba, Rye, N.Y.

[73] Assignee: Minami International Corporation, New York, N.Y.

[21] Appl. No.: 917,910

[22] Filed: Jun. 22, 1978

[51] Int. Cl.[2] ..... H01H 85/02

[52] U.S. Cl. ..... 337/198; 337/259; 337/289

[58] Field of Search ..... 337/188, 197, 198, 216, 337/256-259, 283, 284, 289, 292-294

[56] References Cited

U.S. PATENT DOCUMENTS

| | | | |
|---|---|---|---|
| 453,111 | 5/1891 | Edson . | |
| 495,038 | 4/1893 | Hill . | |
| 498,698 | 5/1893 | Ruggles . | |
| 1,926,936 | 9/1933 | Casingena et al. . | |
| 1,987,547 | 1/1935 | Bredl | 337/289 |
| 2,137,593 | 11/1938 | Skojec | 337/284 |
| 2,141,563 | 12/1938 | Skojec | 337/197 |
| 2,528,971 | 11/1950 | Philips . | |
| 2,676,223 | 4/1954 | Whitaker . | |
| 2,688,062 | 8/1954 | Edman | 337/289 |
| 2,874,248 | 2/1959 | Tondat et al. . | |
| 3,833,875 | 9/1974 | Holoka | 337/269 |

FOREIGN PATENT DOCUMENTS 325272 3/1935 Italy .

*Primary Examiner*—R. L. Moses
*Attorney, Agent, or Firm*—John A. Howson

[57] ABSTRACT

A multiple fuse device having a multiple fuse assembly within the device rotatable about an axis in fixed directions through at least a certain predetermined angle and having at least two rotational positions in which at least one fresh fuse is connected between an electrical source and a load circuit, the improvement characterized by the assembly having a body with a conductor carrying portion having a plurality of radially extending angularly spaced apart separate conductors carried by said portion, at least three adjacent ones of said conductors being connected in a set in series each to its adjacent conductor by fuse means and at least one of the conductors in this set being connected with the source and an adjacent conductor simultaneously being connected with the load circuit to fusibly connect one line of the load circuit with the electrical source when the assembly is in a selected rotational position.

10 Claims, 5 Drawing Figures

FIG. 4
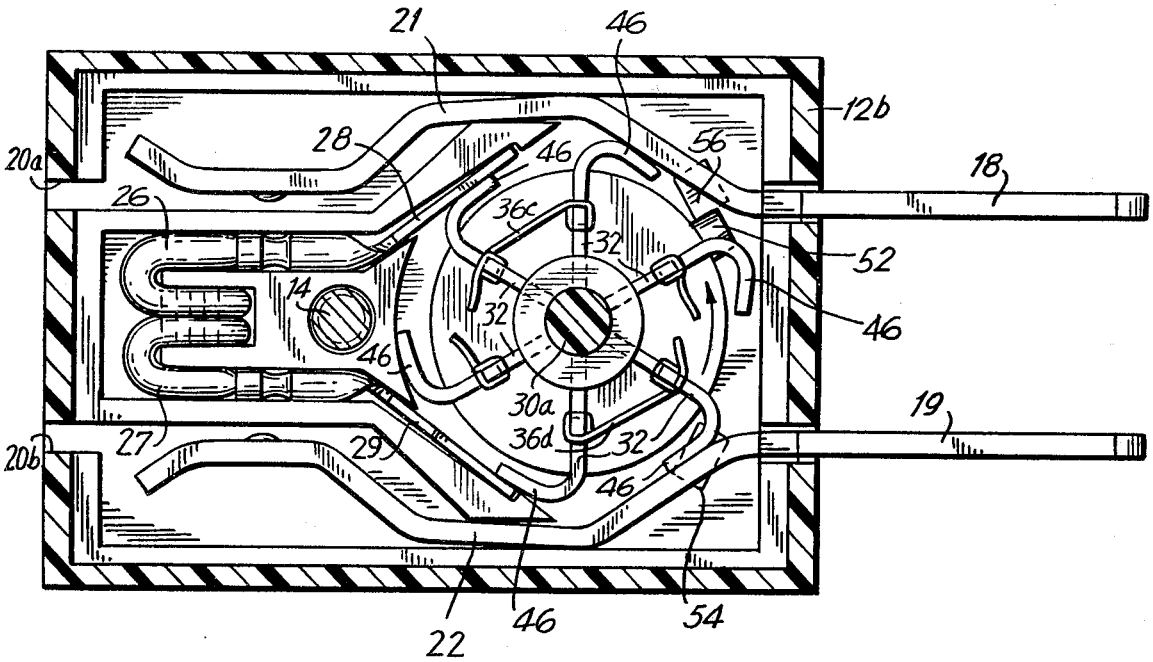
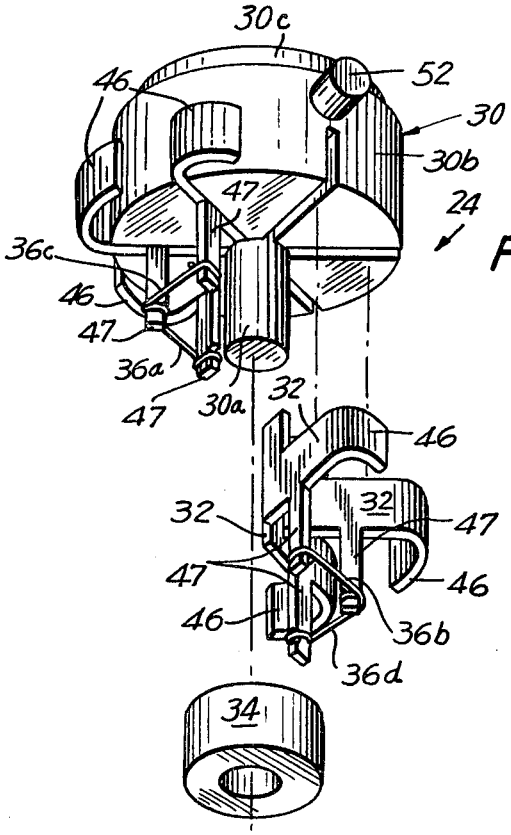
FIG. 5

MULTIPLE FUSE DEVICE

BACKGROUND OF THE INVENTION

This invention relates to multiple fuse devices and more particularly to devices incorporating a rotating means for bringing a fresh fuse into circuit between an electrical source and a load to be protected by the device.

Multiple fuse devices with means for rotating one or more elements to connect a fresh fuse between the conductors supplying electricity to the device, and the load protected by the device, are known. Some of them are disclosed in U.S. Pat. Nos. 453,111; 495,038; 498,698; 1,987,547; 2,141,563; 2,688,062; and Italian Patent No. 352,272. All of these devices have drawbacks which are undesirable.

SUMMARY OF THE INVENTION

The invention provides an improved, reliable, easy to manufacture, simple to operate, but difficult to operate accidentally, multiple fuse device fo protecting a selected load from an overcurrent condition. The device includes a multiple fuse assembly rotatable about an axis within the device in fixed directions through at least a certain predetermined angle and has at least two rotational positions in which at least one fresh fuse is connected between the source and the load circuit. One feature is characterized by the assembly having a body with a conductor carrying portion having a plurality of radially extending angularly spaced apart separate conductors carried by said portion, at least three adjacent ones of said conductors being connected in a set in series each to its adjacent conductor by fuse means and at least one of the conductors in this set being connected with the source and an adjacent conductor simultaneously being connected with the load circuit to fusibly connect one line of the load circuit with the electrical source when the assembly is in a selected rotational position.

The device also includes at least one stop member for limiting the rotational travel of the multiple fuse assembly about its axis and the assembly itself includes means for engaging the stop member for this purpose. The assembly further includes a slot accessible from the exterior of the device for inserting a screwdriver or a coin to move the assembly from one rotational position to another to bring a fresh fuse into circuit with the load protected by the device. The preferred embodiment of the device according to the invention comprises a multiple fuse plug having parallel prongs for connecting the device to a source of electricity. The plug also includes at least two sets of electrical output conductors, at least one of which sets is not connectable to any fuse within the device and at least another of which is connectable to the fusible links within the device according to the rotational position of the multiple fuse assembly within the housing.

Further other features, additional objects, and advantages of the invention will become apparent upon consideration of the drawings, the detailed description of the invention and the appended claims.

BRIEF DESCRIPTION OF THE DRAWINGS

FIG. 4 is a vertical section view of the embodiment of FIG. 1 as illustrated in FIG. 3, but with two of the fuses blown and with a fresh set of fuse wires already rotated in the direction shown by the arrow into a position in which they are connected with and protecting the load circuit intended to be protected by the device.

FIG. 5 is an exploded view of the multiple fuse assembly portion of the preferred embodiment of the invention illustrating the various parts that rotate and how they fit together.

DESCRIPTION OF THE PREFERRED EMBODIMENT

Figure 1:
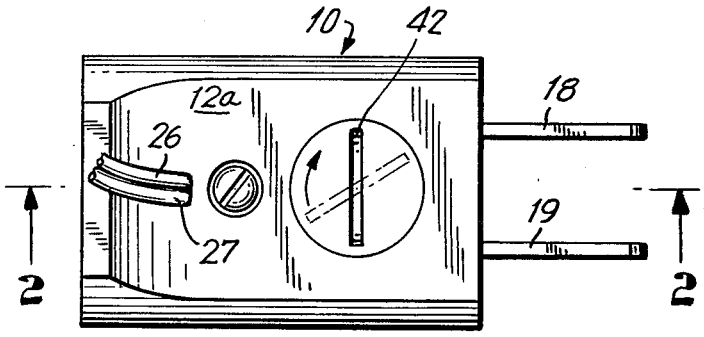
FIG. 1 is a front elevation view of the preferred embodiment of a device according to the invention.
Figure 2:
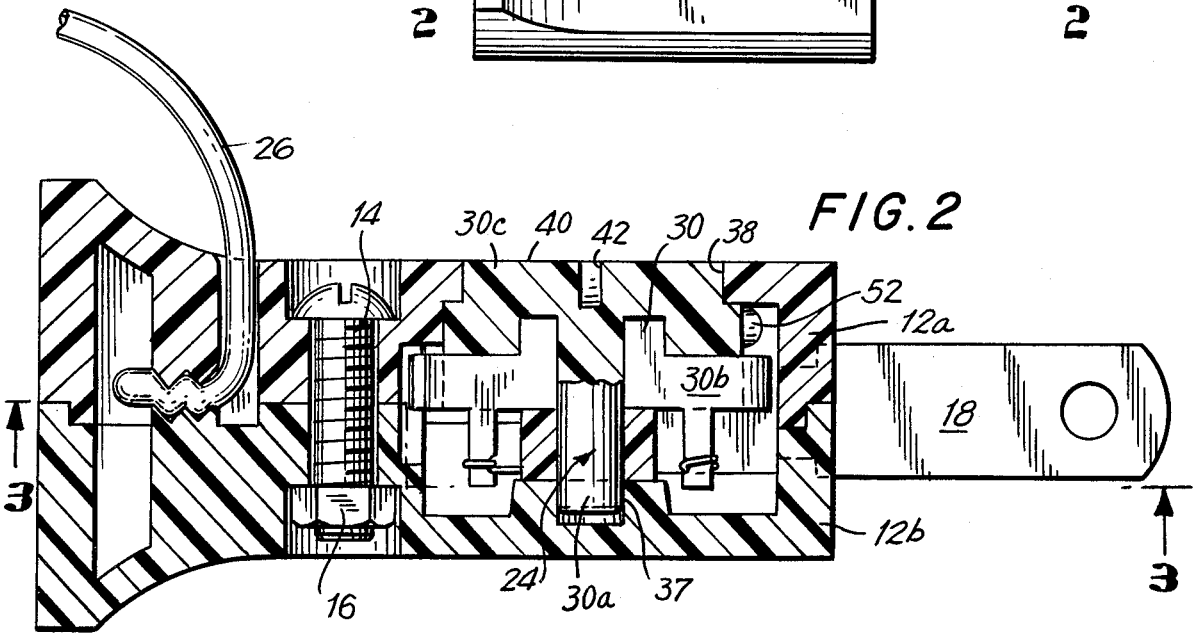
FIG. 2 is a vertical section view of the embodiment of FIG. 1 taken along lines 2—2 of FIG. 1.
Figure 3:
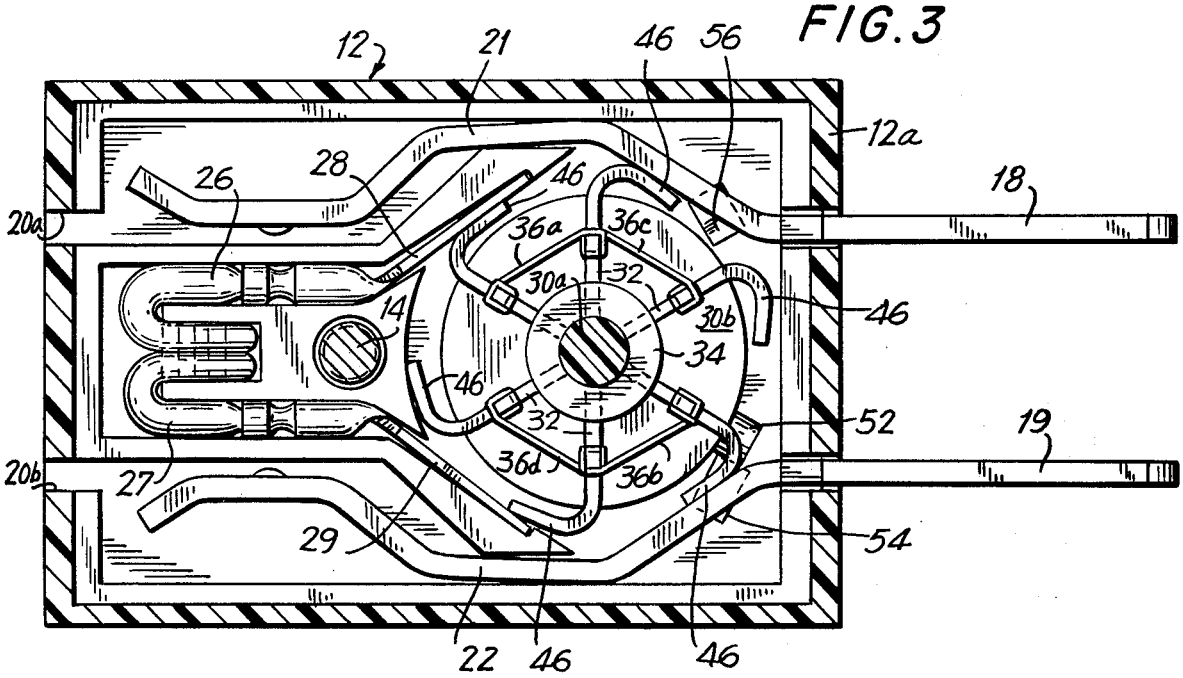
FIG. 3 is a vertical section view of the embodiment of FIG. 1 taken along lines 3—3 of FIG. 2.

Referring now to FIGS. 1–3, the preferred embodiment of a multiple fuse device, according to the invention, comprises a plug 10 for supplying a fused quantity of electricity to a load such as a 110 volt miniature Christmas tree light set. The plug 10 includes a housing 12 comprising an upper half 12(*a*) and a lower half 12(*b*) which are tightly secured together by a screw 14 and nut 16 recessed in the body 12 in a conventional manner (see FIG. 2). Extending to the right of the housing 12, in a conventional manner as seen in FIG. 1, are blade portions 18, 19 of a pair of conductors 21, 22 which supply the plug 10 with electricity, when the blade portions are inserted into a live electrical socket in a known manner. As illustrated in FIG. 3, at its left-hand end, the housing 12 also has openings 20(*a*) and 20(*b*) for receiving the blade portions (not shown) of another plug to supply electricity via the opposite ends of conductors 21, 22 to that plug as well.

The multiple fuse device according to the invention also includes a multiple fuse assembly 24 for receiving and carrying electricity from the conductors 21, 22 to the load via lead lines 26, 27 and their terminal ends 28, 29. The conductors 21, 22 simultaneously pass electricity both through the multiple fuse assembly to the fuse protected load and to any other plug connected to them through openings 20(*a*) and 20(*b*), but only a selected load, namely that connected to the load lines 26, 27 is protected by the fuse device according to this invention.

The multiple fuse assembly 24 preferably includes a body 30 made of a conventional insulating material such as any synthetic resin conventionally used for this purpose, at least six identical flexible electrical conductors 32 mounted in radial slots 44 in the body 30, a spacing collar 34, and fusible links 36. The body 30 is divided into three parts, a shaft or cylindrical post end portion 30(*a*), a middle portion 30(*b*) and a slotted or grooved end portion 30(*c*). The shaft portion 30(*a*) is rotatably positioned in a bearing stand 37 in the lower half 12(*b*) of the housing as seen in FIG. 2. The middle portion 30(*b*) is also cylindrical and lies within the housing with its periphery adjacent to but spaced the same distance from both the conductors 21, 22 and the terminal ends 28, 29 of the lead lines 26, 27. The slotted end portion 30(*c*) is additionally cylindrical and is mounted in a circular opening or hole 38 in the upper half 12(*a*) of the housing so that the end face 40 of the end portion 30(*c*) lies substantially flush with the exterior surface of the plug 10. A slot or groove 42 is formed in the end face 40 so the user can insert a screwdriver or a coin in it and rotate the assembly clockwise as seen in FIG. 1 to bring fresh fuses into circuit with the protected load. Preferably, the end face 40 has a color which contrasts with that of the outer surface of the plug 10 so anyone using the plug can easily identify what portion must be rotated to bring a fresh fuse into circuit with the load protected by the device.

Six radial slots 44 are formed in the bottom of the middle portion 30(*b*) at equal angular separations from its neighbors. Each slot 44 contains a conductor 32 having a flexible portion 46 extending radially beyond the slot for frictional engagement and electrical connection with: nothing; a selected one of the conductors 21, 22; or one of the terminal ends 28, 29 according to the rotational position of the assembly.

As seen in FIG. 3, conductor 21 and terminal end 28 are associated together and are adapted to carry electricity from one side of the 110 volt source. The conductor 22 and terminal end 29 are also associated together and are adapted to carry electricity from the other side of the 110 volt source. Connecting conductor 21 and terminal end 28 are an adjacent pair of conductors 32 in the assembly 30. The end portion 46 of one of them engages the conductor 21 while the end portion 46 of the other engages the terminal end 28. Connecting the two conductors 32 together to complete the circuit is a fuse wire 36 which is wound around and extends between the downwardly extending arms 47 of the conductors 32 (see FIGS. 3 and 5).

The conductor 22 and terminal end 29 are similarly connected by an adjacent pair of conductors 32 tied together by a fuse wire 36. In the preferred embodiment, the six conductors 32 are divided into two sets of three, each of which is associated with either one of the associated conductor 21 and terminal end 28 or the other of the associated conductor 22 and terminal end 29. All arms 47 of the conductors 32 in each set are connected in series by a fuse wire 36, but the two sets of conductors 32 are electrically insulated from each other.

The net effect of this construction is to insert a fusible link into both sides of the 110 volt source providing double pole fused protection to the circuit connected to the lead lines 26, 27. With the assembly 30 in the position shown in FIG. 3, the lead lines are fused by fuse wire links 36(*a*), 36(*b*) and when in the position shown in FIG. 4 they are protected by fuse wire links 36(*c*), 36(*d*). Engagement of a stop member 52 on the middle portion 30(*b*) of the assembly 30 with a stop member 54 in the upper half 12(*a*) of the housing assures the correct rotational position of the assembly for providing one set of fuses to the lead lines 26, 27. Rotation of the assembly about 60° in the direction shown by the arrow in FIG. 1 will bring stop member 52 into engagement with a second stop member 56 in the upper half 12(*a*) of the housing and assures the correct rotational position of the assembly 30 for providing another set of fuses to the lead lines 26, 27. It should be clear, therefore, that a simple rotation of the assembly by means of a screwdriver or a coin will remove the old fuses and bring a new set into circuit with the lead lines. There is no need to unscrew anything or to take anything apart to achieve this result.

Collar 34 of the multiple fuse assembly 24 fits snugly over the post portion 30(*a*) and helps maintain the connectors 32 in position in their slots 44. In addition, collar 34 fits between the lower face of the body 30(*c*) and the upper face of the bearing stand 37 and acts as a spacer to position and maintain the body assembly 24 in the proper vertical position (see FIG. 2) between the plug halves 12(*a*) and 12(*b*).

Various modifications and changes may be made to the preferred embodiment within the scope of the invention. First, the angular separation of the conductors 32 need not be 60°. The separation may be 45° or at any desired angle which permits the device to operate properly. The positions of the terminal ends 28, 29 and the positions of the conductors 21, 22 engaged by the conductors 32 inside the device may be moved closer to one another or further apart as desired. In such a construction, of course, the stop members 54, 56 would have to be moved and perhaps a detent device provided to indicate when a new fresh fuse position has been reached in rotating the assembly.

Second, though the preferred embodiment of the invention takes the form of a plug which has a female socket for transmitting unfused electricity to other load circuits in addition to fusibly protecting the selected load of lead lines 26, 27, the device according to the invention need not take the form of a plug at all, but may be incorporated in a switch or other housing wherever a multiple fuse device is needed. Similarly, though the preferred embodiment has been described as being usable with a 110 volt electrical power source, the device according to the invention can be made for use with other voltages as well as power requirements which are greater than or less than that of the illustrative miniature Christmas tree light set discussed in the description of the preferred embodiment.

Third, though in the preferred embodiment, the device according to the invention inserts fuses into both sides of the electrical power source, in some cases it may be desirable to fuse only one side. In such cases, one conductor from the source can be connected directly to the appropriate line of the load to be protected. While the 60° separation multiple fuse assembly can provide up to 5 fuses or fuse links for the protected line, even more fuse links can be provided in such a device where the separation between the conductors 32 is 45° or whatever other separation less than 60° is chosen for the particular application. The assembly could also be divided into thirds so as to enable the fusing of three lines simultaneously. In any event, the stop members would have to be appropriately positioned for the configuration chosen.

Finally, it should be noted that the multiple fuse assembly portion of any device according to the invention can be easily replaced when all the fuses have blown, by simply opening the housing, lifting the old assembly out, replacing it with a new one having fresh fuse links and closing the housing again.

Further other and additional modifications may also be made within the scope of the invention.

What is claimed is:

1. In a multiple fuse device connectable to an electrical source and at least one selected load circuit for protecting at the selected load circuit from an overcurrent condition, the device having a multiple fuse assembly rotatable about an axis within the device in fixed directions through at least a certain predetermined angle and having at least two rotational positions in which at least one fresh fuse is connected between the source and the load circuit, the improvement characterized by the assembly having a body with a conductor carrying portion having a plurality of radially extending angularly spaced apart separate conductors carried by said portion, at least three adjacent ones of said conductors being connected in a set in series to its adjacent conductor by fuse means and at least one of the conductors in this set being connected with the source and an adjacent conductor simultaneously being connected with the load circuit to fusibly connect one line of the load circuit with the electrical source when the assembly is in a selected rotational position.

2. The improvement according to claim 1 wherein the device has a housing with a length and a width which are both greater than the thickness of the device and the axis about which the multiple fuse assembly rotates is perpendicular to the length and width of the device.

3. The improvement according to claim 1 wherein the device has at least two sets of electrical output conductors, at least one of which sets comprises leads to the selected fused load circuit and at least another of which sets passes electricity from the source through the device without connection to any fuse means.

4. The improvement according to claim 1 wherein both the device and the multiple fuse assembly each include a stop member for limiting the rotational motion of the assembly whenever it reaches a predetermined rotational position in the device.

5. The improvement according to claim 3 or 4 wherein the device comprises a multiple fuse plug having parallel prongs for receiving electricity from the source and the axis about which the multiple fuse assembly is rotatable is perpendicular to a plane through the centerline of both prongs.

6. The improvement according to claim 1 wherein the conductor carrying portions of the multiple fuse assembly body carries at least six separate conductors and each conductor extends radially outwardly from the assembly's axis of rotation at equal angles from its adjacent conductors.

7. The improvement according to claim 6 wherein there are two sets of an equal number of conductors carried by the assembly body, each set being located around said axis on a different 180° segment of said body, the two sets being electrically separate, but each fusibly connecting one of the lines from the load circuit with its associated line from the electrical source when the assembly is in any selected one of at least two of its rotational positions.

8. The improvement according to claim 1 wherein the device includes a body having a circular opening in it through which one end of the multiple fuse assembly is accessible and there is a slot formed in that end for engagement with a tool for rotating the assembly to at least two selected positions.

9. The improvement according to claim 3 wherein the device comprises a multiple fuse plug with parallel prongs for connecting the device to a source of electricity, the axis about which the multiple fuse assembly is rotated is perpendicular to a plane through the centerline of both prongs, and the assembly includes a stop member for limiting the rotational motion of the assembly whenever it reaches either one of two predetermined rotational positions in the device.

10. The improvement according to claim 9 wherein there are an even number of at least six slots formed in the multiple fuse assembly body, each extending radially outwardly from the assembly's axis of rotation at equal angles to its adjacent slots, there is a conductor in each slot and the conductors in the slots on opposite halves of the body about the axis of rotation form a separate set, each member of which is connected to its adjacent conductors by a fusible wire, wherein the two sets are not connected together but two conductors of each set fusibly connect a different line of the load circuit with its associated line from the electrical source when the assembly is in a selected one of its rotational positions.

* * * * *

Dedication 4,196,409.—*Hisashi Juba*, Rye, N.Y. MULTIPLE FUSE DEVICE. Patent dated Apr. 1, 1980. Dedication filed Mar. 31, 1980, by the inventor. Hereby dedicates to the Public the entire term of said patent.

[*Official Gazette January 6, 1981.*]